United States Patent [19]

Flower et al.

[11] 4,113,007

[45] Sep. 12, 1978

[54] RECUPERATOR

[75] Inventors: Robert J. Flower; Clarke R. Snedeker, both of Lockport; Paul K. Beatenbough, Medina, all of N.Y.

[73] Assignee: General Motors Corporation, Detroit, Mich.

[21] Appl. No.: 789,066

[22] Filed: Apr. 20, 1977

[51] Int. Cl.[2] ..... F28F 5/00

[52] U.S. Cl. ..... 165/81; 165/166; 122/510; 432/223

[58] Field of Search ..... 165/67, 81, 157, 166; 122/510; 432/223; 60/39.51

[56] References Cited

U.S. PATENT DOCUMENTS

| | | | |
|---|---|---|---|
| 2,703,559 | 3/1955 | Godshalk | 122/510 X |
| 2,876,975 | 3/1959 | Short | 248/58 |
| 3,385,353 | 5/1968 | Straniti et al. | 165/67 |
| 3,718,182 | 2/1973 | Rossetti | 165/166 |
| 3,866,674 | 2/1975 | Tramuta et al. | 165/166 |
| 3,877,519 | 4/1975 | Tramuta et al. | 165/166 |

*Primary Examiner*—Charles J. Myhre

*Assistant Examiner*—Theophil W. Streule, Jr.

*Attorney, Agent, or Firm*—K. H. MacLean, Jr.

[57] ABSTRACT

A rapid heat recuperative heat exchanger particularly adapted for use with large gas turbine engines, including a heat exchanger core which is composed of a plurality of spaced plate members. The core is supported within a skeleton framework by hanger members, the lower ends of which are slidably attached to horizontal control rods which extend through aligned openings in the core plates and which guide movement of the plates in an axial direction to the rods due to thermal expansion. Pressurized air is introduced to the core by inlet and outlet fittings on the end of the core which are of significantly greater thickness than the plate members. It is undesirable to join active heat exchange members of widely varying masses and differing cross-sections. Therefore, the end plate of the core is made of material having the same thickness as the inlet and outlet fittings. Progressing from the relatively thick end plate, the plates are gradually decreased in thickness until a desired plate dimension is achieved.

5 Claims, 5 Drawing Figures

RECUPERATOR

This invention relates to recuperative heat exchangers, particularly those utilized with gas turbine engines and is characterized by structural features permitting rapid warmup and significantly decreased startup time for the heat exchanger.

Large gas turbine power sources are utilized in applications such as natural gas pumping operations. The efficiency of gas turbine engines is greatly enhanced by the pre-heating of input air to the combustion chamber. Thus, it is common to find heat exchangers used for this purpose which receive exhaust gases from the turbine stage and pressurized air from the compressor stage with heat exchange occuring therebetween prior to passing the pressurized air into the combustion chamber.

When a large and very powerful turbine power source is utilized, it is necessary to employ a very large heat exchanger apparatus. It is not uncommon to utilize heat exchanger apparatus having dimensions of about 40 feet in length, 10 feet in width and 12 feed in height. Certain unique problems are associated with heat exchangers of this size. Of course, the installation and shipping of such huge heat exchangers creates difficulties, but in relation to structural considerations, there are many brazed and welded joints in heat exchangers of this type. In addition, there are parts of widely different mass and thickness directly subjected to exceedingly high temperature gases. When a part having a large thermal mass and thickness is attached to a part with a small mass and a thin dimension by a weld, there is a very undesirable tendency for the attached parts to heat up at different rates. This may create stresses in the welded or brazed joint.

The most common procedure for avoiding stresses associated with large heat exchangers of this type is to specify long warmup periods necessary to being the heat exchanger up to operating temperature. One hour, or greater periods, of gradual warming up of the heat exchanger are not uncommon. This is not a significant problem if the gas turbine will be operated all the time. In that case, the heat exchanger can be slowly brought up to operating temperature and very little efficiency and utility are sacrificed.

Where a gas turbine is used intermittently, the normal warmup specifications are unacceptable. There are many such applications where it is desirable to bring a turbine power source and associated heat exchanger up to operating conditions in a short period of time, such as 15 minutes. The subject invention disclosed herein has structural features tending to reduce the effects of thermal shock caused by rapid heat application to a core and thus provide a recuperative heat exchanger which may be started up from ambient temperature to operating temperature in about 15 minutes.

One feature of the subject recuperator which permits the rapid application of heat and resultantly shorter warmup specifications is the balance of mass and cross-section between parts which are joined together. As previously explained, joining a part having a large thermal mass to a part having a significantly smaller thermal mass or cross-section in the direction of heat flow is undesirable and thermal stresses may result following a rapid heatup. Of particular concern in plate-type recuperative heat exchangers is the stress on joints between inlet and outlet fittings and the plates of the heat exchange core. The subject embodiment provides an end plate having a thickness 0.250 inches, equal to the thickness of the inlet and outlet fittings. Proceeding inward with respect to the core, the plate thickness gradually decreases by a ratio of about 2:1 between adjacent plates. The even heating between matched adjacent parts minimizes thermally caused stresses resulting from the rapid application of heat to the core.

Another feature of the subject recuperator is the structural support of the heat exchanger core within a skeleton framework. A plurality of hanger rods are attached to the frame at an upper end. The rods extend downward and engage horizontal growth control rods which extend through either side of the core. Specifically, the control rods extend through aligned openings in the plates which are free to move thereon. Control rods act as a guide for thermal growth of the core in the axial direction of the control rods. In addition, the rod support of the core by the hanger rods permits the cores to freely expand in the planar directions of the plate members. The skeleton framework from which the hanger rods extend also supports insulative panels along the sides of the core which help direct exhaust gases through the gas passages of the core and permit the core to expand thereagainst.

The aforementioned structural features will be described hereinafter in more detail. The resultant unity between framework and core present desirable ease in transportation and installation. The framework surrounds and protects the relatively fragile core during shipment and thereafter. It permits total assembly at the manufacturing facility and minimizes the on-site construction and installation costs and problems.

Further features and advantages of a subject recuperator will be more apparent from the following detailed description, reference being had to the accompanying drawings in which a preferred embodiment is illustrated.

IN THE DRAWINGS

Figure 1:
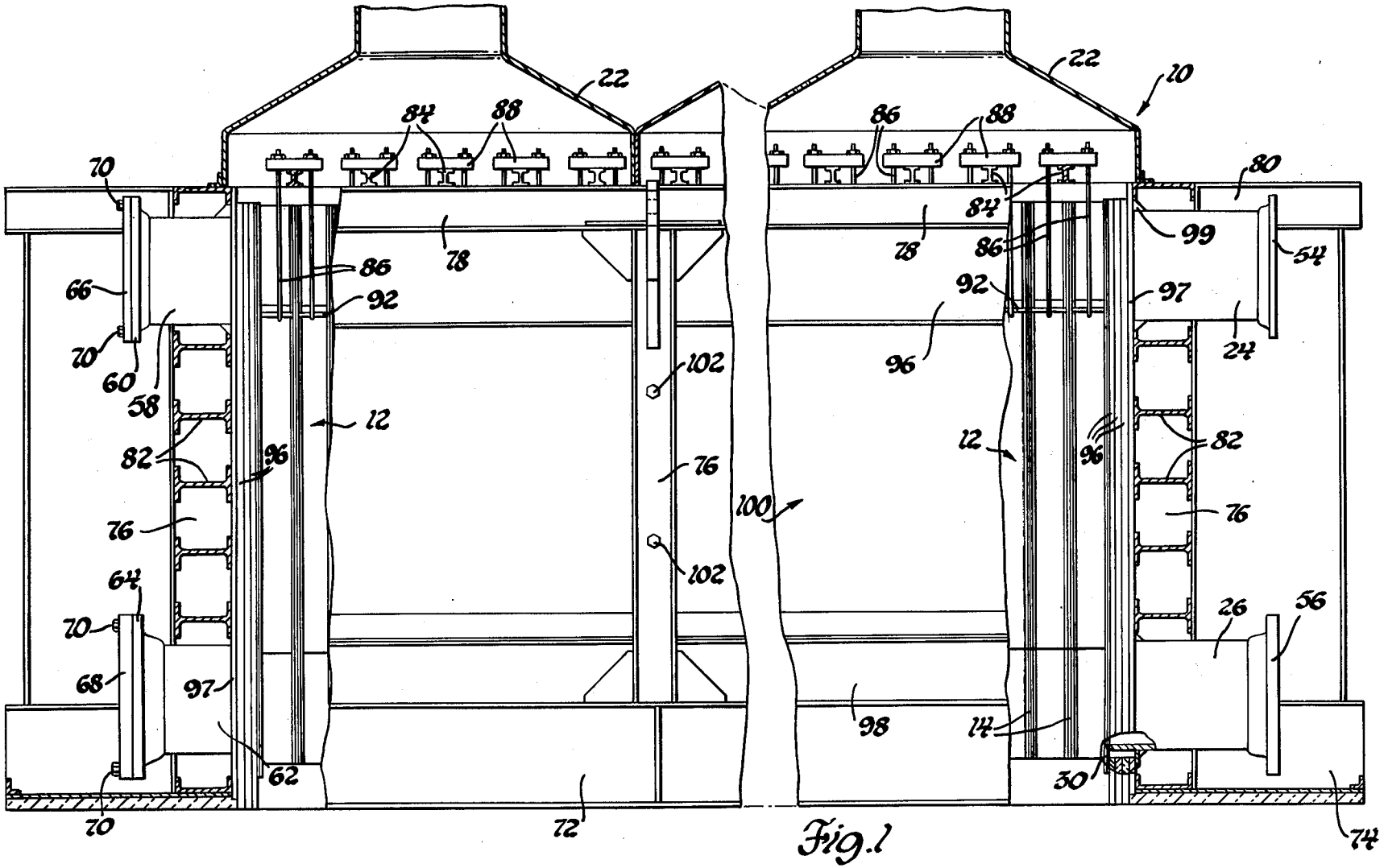
FIG. 1 is a side elevational view of the recuperator broken away to reveal structural features of the frame and core.
Figure 2:
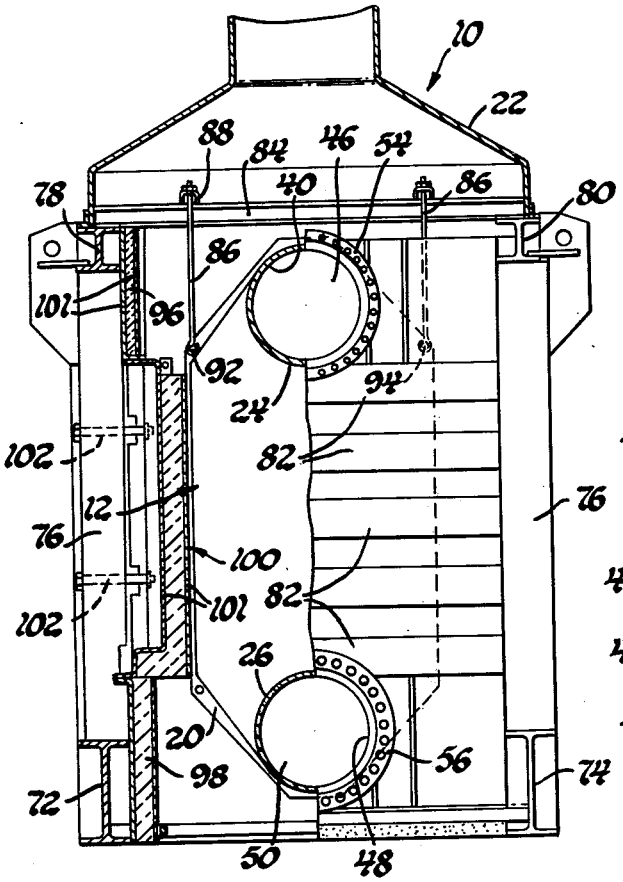
FIG. 2 is an end elevational view broken away to reveal structural features.
Figure 4:
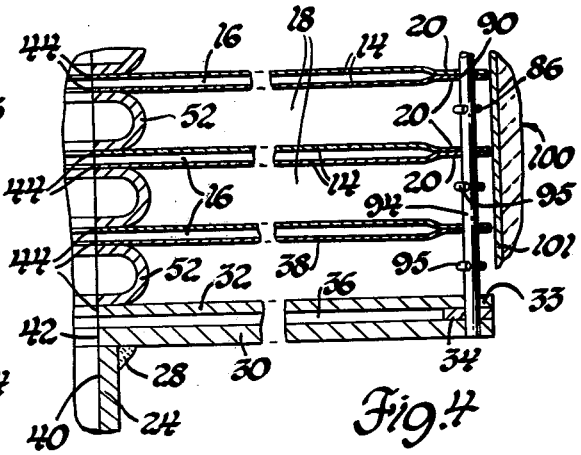
FIG. 4 is a fragmentary sectioned view of the core's plate structure.

Referring to FIGS. 1 and 2, a plate-type recuperator 10 is illustrated, including a heat exchange core 12 which is made up of many thin plate members 14 stacked together in a parallel sandwich fashion but slightly spaced from one another to form alternating air and gas passages therebetween. Referring briefly to FIG. 4, the air passages 16 and the exhaust passages 18 are formed alternately between adjacent plates. Gas passages 18 have a significantly greater flow height (spacing between the plates) than the air passages 16. This provides approximately equal volumes of flow since the flow of exhaust gases is influenced by only slight pressurization, while the air flow is influenced by a significant pressurization which may be many times atmospheric pressure. The air passages 16 are enclosed between pairs of adjacent plates whose outward edges 20 are offset from the plane of the plate midportion and may be bonded together by brazing to form air modules or bundles. Unbonded plates are believed to be possible with high air pressures. The gas passages 18 are located between air bundles and the side boundaries of the passages 18 are defined by metal-sheathed insulative members to be discussed in more detail hereinafter.

The exhaust gases at elevated temperatures flow from the turbine stage of the gas turbine and enter the bottom of core 12 from a lower duct (not shown). After passing between the plates 14 in passages 18, the exhaust gases exit from the top of the heat exchange core 12 and into converging ducts 22 for eventual release to the atmosphere.

Figure 5:
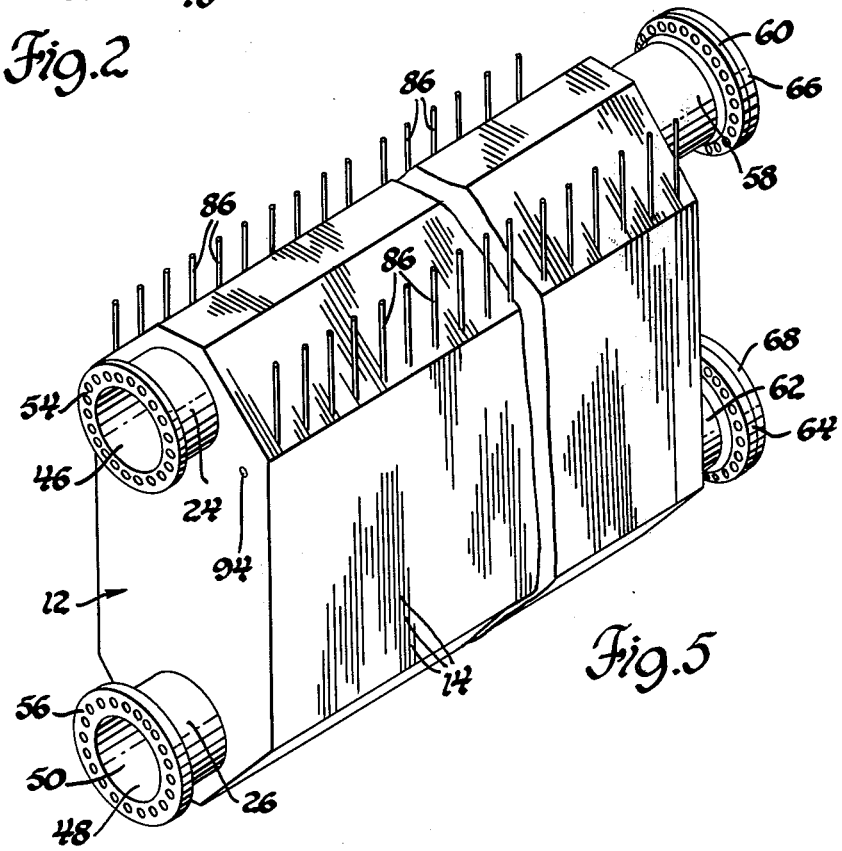
FIG. 5 is a perspective view of the plate type heat exchange core without the associated supporting frame.

Pressurized air from the compressor stage of the associated gas turbine enters the heat exchange core 12 through an inlet fitting or conduit 24 at an upper end location of the core as shown in FIG. 5. Likewise, heated air exits from the core through an air outlet conduit 26 located at a bottom end location of the core as shown in FIG. 5. Referring back to FIG. 4, the connection between the core 12 and the air inlet conduit 24 is illustrated. Although not shown, the attachment between the air outlet conduit 26 and the core is made in an identical manner. Specifically, conduit 24 is welded at location 28 to a relatively thick end plate 30. The thickness of the inlet conduit 24 and end plate 30 are approximately the same and in the embodiment shown, the thickness is 0.250 inches. The matching of thickness or mass between joined parts is desirable to provide a strong weld between the members which will not cause warpage of the members. As discussed previously, the equalization of the thermal masses or thicknesses between conduit 24 and plate 30 minimizes uneven heating therebetween and the formation of thermal stresses when the recuperator is rapidly brought up to operating temperature.

Progressing inward from end plate 30 toward the midportion of core 12, the second plate 32 is operably attached at outer edge 33 to end plate 30 by brazing. A spacer or bar member 34 is placed between the end portions to separate the relatively thick plates, thereby forming an end air passage 36 therebetween. To more nearly equalize the thermal masses between the remaining plates, the thickness of the second plate 32 is approximately half the thickness of end plate 30. Likewise, the third plate 38 is again half the thickness of the adjacent plate 32.

In the specific recuperator embodiment illustrated and discussed herein, the thickness of the midposition plates 14 is considerably less than the end pieces or the inlet conduit 24 by a factor of about 6. Welding a thin member to a thick member such as inlet conduit 24 would be very difficult and a consistent strong weld therebetween would be unlikely. Consequently, plate 38 has a thickness of two times that of the plates 14 and plate 32 has a thickness of 4 times plate 14, while the end plate 30 and conduits 24, 26 have a thickness of about 6 times plate 14.

As previously explained, the air inlet and outlet conduits 24 and 26 are attached to end plate 30. Referring to FIG. 4, the inner diameter bore 40 of the conduit 24 is aligned with an identical opening 42 in the plate 30. Likewise, the plates 32, 38 and the plates 14 also have aligned openings 44 therein. The channel thus formed through the core 12 defines an inlet plenum 46 which is also shown in FIG. 2. Likewise, similar openings aligned with the bore 48 of the outlet conduit 26 at the lower end of the core 12 form an outlet plenum 50. The inlet and outlet plenums are communicated with the air passages 16 by the slotted openings formed between pairs of plates 14. The gas passages 18 are not communicated with plenums 46, 50. Annularly-shaped spacer members or C-rings 52 are welded between plates 14 to cover the alternate slotted openings on the inside of gas passages 18.

The air enters the core 12 through the inlet conduit 24 which has a radially outwardly extending flange portion 54 adapted to be sealingly attached to a duct or conduit leading to the outlet of the compressor stage of the gas turbine. Likewise, the outlet conduit 26 has a flange 56 adapted to be connected by a conduit to the inlet of the turbine's combustion chamber. At the far end of the core 12, a fitting 58 with flange 60 is located at the upper end. Likewise, a similar fitting 62 with flange 64 is located at the lower far end of the core 12. Attached to the flanges 60, 64 are covers 66, 68 fastened thereto by fasteners 70. These fittings form alternate inlets and outlets to the core. When not utilized as inlets and outlets, they provide access to the core interior for fabrication and maintenance.

So far, the active heat exchange elements of the recuperator, such as core 12, have been discussed. Also important is the associated core support structure. The recuperator 10 includes spaced lower beams 72, 74 which extend normal to the plates 14. Beams 72, 74 form the footing for vertical extending side beams 76 which are spaced along beams 72, 74. The side beams 76 support upper beams 78, 80 which extend parallel to the lower beams 72, 74. The two ends of the core 12 are retained in a direction normal to the plates 14 by horizontally disposed end beams 82 attached at their end portions to the side beams 76 so as to engage the ends of the core 12. The end buttress formed by members 76, 82 is particularly rigid, as is evident from FIG. 1. The rigidity is desirable because the pressurized air in passages 16 acting upon the large end area produces a very great force. In the illustrated embodiment, the end area of the core has a height dimension of about 9 feet and a width dimension of about 5 feet, thereby producing an end area of approximately 54 square feet, or almost 6500 square inches.

The heat exchanger core 12 is suspended from the structural frame on cross beams 84 which extend normal to upper beams 78, 80. As best shown in FIGS. 1 and 2, a plurality of hanger rods 86 are attached in pairs to the opposite ends of short beam members 88 which lie across beams 84. The lower ends of hanger rods 86 engage horizontally disposed control or guide rod members 92, 94. Guides 92, 94 extend through aligned openings 90 adjacent the edges 20 of plates 14. The plates 14 are free to slide axially along the guides 92, 94 in response to thermal expansion and pressure forces on the plates. The guide members 92, 94 are supported at a plurality of locations by hooked end portions 95 of the hangers 86. As the core 12 grows in an axial direction with respect to guide members 92, 94, the plate members 14 are freely slid to relieve stresses which would otherwise occur due to a fixed attachment of the plate to a support member.

Figure 3:
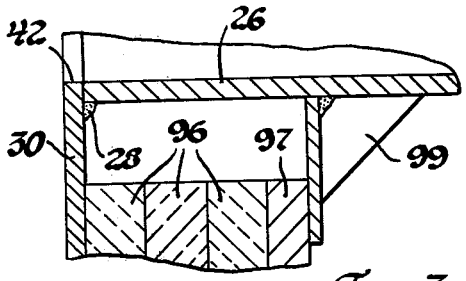
FIG. 3 is a fragmentary sectioned view of the joint between the air inlet conduit and the end plate shown in FIG. 1.

As previously indicated, the ends of the core 12 are restrained by the end members 82 which are attached to side members 76. This defines the maximum length of the core. Both to support the ends of the core and to insulate the core to prevent unnecessary heat losses by the heating of the structure ends, a plurality of sheets of hard insulation board 96 are provided at either end or core 12. An outer plate 97 is provided as a backup for the insulation and is attached by corner braces 99 to the fittings 24, 26 as shown in FIG. 3. Also, insulating panels are provided along the side of the core to prevent heat losses and to direct the exhaust gases vertically through the core 12. Specifically, insulating panels 96, 98 are located along the upper edge and lower edge portions of both core sides. In addition, an insulating panel 100 is placed adjacent the midportion of both sides. The panels 96, 98, 100 are sheathed with thin stainless steel walls 101 and panel 100 is easily removable for access to the core 12 by a plurality of bolt fasteners 102.

The illustrated recuperative heat exchanger is a massive piece of heat exchange equipment. The size alone, as set forth in the following table, increases the magnitude of the identified problems during a rapid warmup. Smaller heat exchange equipment probably would not be characterized by the problems discussed herein.

| Approximate Dimensions and Data | | |
|---|---|---|
| Length | 502" | (41' 10") |
| Width | 115" | (9' 7") |
| Height | 155" | (12' 11") |
| Core length | 383" | (31' 11") |
| Core width | 78.5" | (6' 6.5") |
| Core height | 133.5" | (11' 1.5") |
| Insulation, End (example) | | |
| Johns-Manville, Marinite-23 | | |

Upon startup of the gas turbine, the core of the subject recuperator is almost immediately subjected to extreme temperatures. The exhaust gases entering the recuperator soon after turbine startup will rapidly exceed one thousand degrees (1000° F.) Accordingly, the core 12 is subject to extreme thermal gradients which would harm the core unless somehow alleviated. The subject recuperator provides structural features which enable it to successively withstand the shock of extreme temperature gradients. Therefore, the utility of the subject rapid startup recuperator is greatly enhanced by the aforementioned features, and although a single specific embodiment has been illustrated and described in detail, design modifications of the structure are contemplated which would not alter the inventive features as defined in the following claims which define the invention.

What is claimed is as follows:

1. A rapid startup recuperative heat exchanger, including a core with air and gas passages formed between spaced plate members which extend in substantial parallelism with one another; said plates of the core having openings therein aligned with one another along both sides of the core; guide rod means extending through said aligned openings in a generally horizontal direction and engaging said plates in a manner permitting sliding movement thereon while maintaining alignment of said plates; a frame including upper beam members extending substantially parallel to said guide rods; connecting means between said beam members and guide rods for supporting said core; insulative panels extending in closely spaced parallelism to the core sides in contact with the gas in said gas passages to form yieldable side walls of the gas passages; air inlet and outlet fittings joined to the end plate of said core for passage of pressurized air to and from said air passages; said fittings and said end plate having substantially equal thicknesses to reduced resistance to heat flow and promote even heating thereof during a rapid core warmup; means for preventing abrupt sectional changes between the active heat exchange members, such as said end plate and the adjacent series of plates, by a gradual reduction in thickness between adjacent plates.

2. A rapid startup recuperative heat exchanger, including a core with air and gas passages formed between spaced plate members which extend in substantial parallelism with one another; said plates of the core having openings therein aligned with one another along both sides of the core; guide rod means extending through said aligned openings in a generally horizontal direction and engaging said plates in a manner permitting sliding movement thereon while maintaining alignment of said plates; a perimeter frame extending outside said core and including upper beam members substantially parallel to said guide rods; means operably connecting said upper beam members and said guide rods for core support, including a plurality of depending hanger members spaced along said guide rods; said hanger members engaging said guide rods at their lower ends in a manner permitting relative axial and rotative movement of the guide rods, whereby upon the rapid application of heated gases to the core, the plates may move further apart, thus elongating the core, and may expand in a planar direction, thus moving said guide rods from one another; insulative means extending in closely spaced parallelism to the core sides and in contact with the gas in said gas passages to form side walls of the gas passages while permitting limited movement of the core plates thereagainst; air inlet and outlet fittings joined to the end plate of said core for passage of pressurized air to and from said air passages; said fittings and said end plate having substantially equal thicknesses to reduce resistance to heat flow and promote even heating thereof during a rapid warmup of the core; means for preventing abrupt sectional changes between the active heat exchange members, such as said fittings and said end plate, by a gradual reduction in thickness between adjacent plates, thereby promoting even heating of connected members during rapid warmup of the core.

3. A rapid startup recuperative heat exchanger, including a core with air and gas passages formed between spaced plate members which extend in substantial parallelism with one another; said plates of the core having openings therein aligned with one another along both sides of the core; guide rod means extending through said aligned openings in a generally horizontal direction and engaging said plates in a manner permitting sliding movement thereon while maintaining alignment of said plates; a frame including upper beam members extending substantially parallel to said guide rods; connecting means between said beam members and said guide rods for supporting said core; insulative panel means extending in closely spaced parallelism to the core sides in contact with the gas in said gas passages to form yieldable side walls of the gas passages; air inlet and outlet fittings each in the form of a cylindrical tube having a wall thickness many times the thickness of the average core plate; an end core plate to which said cylindrical tubes are joined having a thickness substantially equal to the tube wall thickness; a core plate adjacent said end plate having a thickness less than the end plate thickness but greater than the average plate thickness, whereby the thickness of the plates decreases gradually in a direction toward the midportion of said core, thereby preventing abrupt sectional changes between attached active heat exchange members to promote even heating during a rapid startup.

4. The recuperative heat exchanger described in claim 1, in which said insulative panels are attached by fasteners to said frame to permit removal from an exterior position for access to said core.

5. The recuperative heat exchanger described in claim 3, in which said inlet and outlet fittings are welded to said end plate and the gradual decrease in plate thickness between plates progresses by a ratio of about 2:1.

* * * * *